US007068222B2

(12) United States Patent
Koparan et al.

(10) Patent No.: US 7,068,222 B2
(45) Date of Patent: Jun. 27, 2006

(54) DUAL BAND ANTENNA

(75) Inventors: Cenk Koparan, Urnäsch (CH); Markus Heiniger, Herisau (CH); André Merten, Herisau (CH); Wolfgang Heyde, Herisau (CH); Martin Köng, Herisau (CH)

(73) Assignee: Huber + Suhner AG, Herisau (CH)

( * ) Notice: Subject to any disclaimer, the term of this patent is extended or adjusted under 35 U.S.C. 154(b) by 0 days.

(21) Appl. No.: 10/510,930

(22) PCT Filed: Apr. 8, 2003

(86) PCT No.: PCT/CH03/00228

§ 371 (c)(1),
(2), (4) Date: Jun. 13, 2005

(87) PCT Pub. No.: WO03/085782

PCT Pub. Date: Oct. 16, 2003

(65) Prior Publication Data

US 2005/0225498 A1 Oct. 13, 2005

(30) Foreign Application Priority Data

Apr. 10, 2002 (EP) ..... 02405285

(51) Int. Cl.
*H01Q 1/38* (2006.01)

(52) U.S. Cl. ..... 343/700 MS; 343/829

(58) Field of Classification Search ..... 343/700 MS, 343/829, 844

See application file for complete search history.

(56) References Cited

U.S. PATENT DOCUMENTS

| | | | | |
|---|---|---|---|---|
| 6,091,365 | A * | 7/2000 | Derneryd et al. | 343/700 MS |
| 6,211,841 | B1 | 4/2001 | Smith et al. | |
| 6,239,750 | B1 | 5/2001 | Snygg | |
| 6,897,809 | B1 * | 5/2005 | Carson et al. | 343/700 MS |
| 2003/0058169 | A1 * | 3/2003 | Heyde | 343/700 MS |
| 2003/0146872 | A1 * | 8/2003 | Kellerman et al. | 343/700 MS |
| 2006/0044189 | A1 * | 3/2006 | Livingston et al. | 343/700 MS |

FOREIGN PATENT DOCUMENTS

| | | |
|---|---|---|
| WO | WO 99/59223 | 11/1999 |
| WO | WO 00/13260 | 3/2000 |
| WO | WO 01/76010 | 10/2001 |

* cited by examiner

*Primary Examiner*—Tan Ho
(74) *Attorney, Agent, or Firm*—The Webb Law Firm

(57) ABSTRACT

A dual band antenna includes a first linear periodic array of first individual antennas for a first frequency band and a second linear periodic array of second individual antennas for a second frequency band. The period of the first linear periodic array is essentially twice as large as the period of the second linear periodic array. The second individual antennas are arranged alternately between the first and above the first individual antennas. The first individual antennas and the second individual antennas are embodied as patch radiators. The first and second individual antennas each include a printed-circuit board arranged in a rectangular, electrically conducting box which is open towards the top in addition to several patch plates which are arranged at a distance on top of each other above the printed-circuit board and parallel to the printed-circuit board.

20 Claims, 3 Drawing Sheets

DUAL BAND ANTENNA

BACKGROUND OF THE INVENTION

This application is a 371 of PCT/CH03/00028 filed on Apr. 08, 2003.

1. Field of the Invention

The present invention relates to the field of antenna technology and, more particularly, to a dual-band antenna.

2. Description of the Related Art

The rising demand for data to be transmitted in the area of mobile radio has led to the definition of the UMTS (Universal Mobile Telecommunication System) standard in the past. Applications based on this standard require a new mobile radio network. A component of this network are antennas which must also be newly developed since the UMTS standard is based on new frequency ranges for transmitting and receiving. The previous mobile radio networks according to the conventional GSM 900/1800 standard, and a number of other networks conforming to other standards, will continue to be operated in parallel with the newly created UMTS standard for a period which cannot yet be predicted. To achieve the construction of a UMTS network which is as rapid as possible, network operators are interested in using existing antenna sites both for the existing networks and to be integrated into the new UMTS network. The development of antennas which cover both the frequency ranges of existing networks and the UMTS frequency ranges enables network operators to shorten the time for the licensing procedures or to cut it out altogether. Furthermore, it is possible to assume that the public acceptance of an individual antenna which covers all locally used mobile radio standards will be higher in comparison with different individual antennas for each standard.

Dual-polarized antennas for base stations consisting of an array of dual-polarized individual radiators (single antennas) have been known for a long time. Similarly, dual-polarized broadband antennas are known which are composed of an array of identical dual-polarized individual radiators which are tuned to frequencies of 1710–2170 MHz over a wide band so that the antenna covers both the GSM 1800 band and the UMTS band. A particularly effective individual radiator of this type which has been successful in practice is known from WO-A1-01/76010. Furthermore, dual-polarized antennas are known which cover the GSM 900 band and the GSM 1800 or GSM 1800/UMTS band and which consist of an array of correspondingly tuned dual-polarized individual radiators.

In U.S.-B1-6,211,841, a multi-band antenna for mobile radio base stations has been proposed in which the frequency bands of GSM 900, GSM 1800 and UMTS are covered by a combination of two arrays with two different individual radiators in the form of crossed dipoles (low-band dipoles, high-band dipoles).

In WO-A2-99/59223, a dual-band antenna is disclosed in which a first linear array of patch radiators for the GSM band (860–970 MHz) is combined with a second linear array of crossed dipoles for the PCN band (1710–1880 MHz), the crossed dipoles being arranged between the patch radiators in a first embodiment and directly above the patch radiators in a second embodiment.

In U.S.-B1-6,239,750, an antenna arrangement for multi-band operation is proposed in which (FIG. 4) two linear arrays of two different patch radiators are combined with one another, the first patch radiators being tuned to the frequency band of 1800–1900 MHz and the second patch radiators being tuned to the frequency band of 800–900 MHz and the first patch radiators being arranged alternately between and directly above the second patch radiators.

To be able to use, on the one hand, the existing antenna spaces at the base stations equally for the previous bands and the new UMTS band and, on the other hand, utilize the advantages of the individual radiator developed by the applicant according to WO-A1-01/76010, it was desirable to use these individual radiators in a dual-band antenna.

It would, therefore, be desirable to create a broadband dual-band antenna which is suitable both for the GSM 900 band and for the GSM 1800 and UMTS band and is based on an individual-radiator type as has been disclosed in WO-A1-01/76010.

SUMMARY OF THE INVENTION

The invention is an arrangement of first and second individual antennas in a linear periodic array, the second individual antennas being alternately arranged between the first and above the first individual antennas and the first and second individual antennas in each case being constructed as patch radiators which in each case comprise a printed circuit board arranged in a rectangular, electrically conductive box open to the top and a number of patch plates which are arranged at a distance above one another above the printed circuit board and in parallel with the printed circuit board. The special feature of this arrangement is that in this case it is not individual patch plates for different frequency bands which are arranged above one another and next to one another but that each of the patch radiators with its printed circuit board arranged in the box is used in the array.

In this arrangement, the patch plates of an individual antenna are preferably held in each case at a distance below one another and from the printed circuit board by means of electrically insulating spacing elements (42 in FIG. 2).

In a preferred embodiment, each second individual antenna includes three patch plates arranged at a distance above one another and each first individual antenna includes two patch plates arranged at a distance above one another, with the box of a second individual antenna arranged above the upper one of said two patch plates. Each second individual antenna is thus a fixed component of the first individual antenna above which it is placed.

The first and second individual antennas are preferably arranged above a common base plate extending in the longitudinal direction of the antenna. The base plate can be constructed to be nonmetallic. However, the base plate can also be constructed as a (metallic) reflector.

Desirably, the first individual antennas are designed for covering the frequency range of 806–960 MHz and the second individual antennas are designed for covering the frequency range of 1710–2170 MHz.

Generally, a balanced dual-band antenna is obtained if a total of N first individual antennas and 2N±1 second individual antennas are arranged in the dual-band antenna (N=integral number>0). A successful embodiment is obtained for N=7.

BRIEF DESCRIPTION OF THE DRAWINGS

In the text which follows, the invention will be explained in greater detail with reference to exemplary embodiments, in conjunction with the drawing, in which.

DETAILED DESCRIPTION OF THE INVENTION

Figures 1, 2:
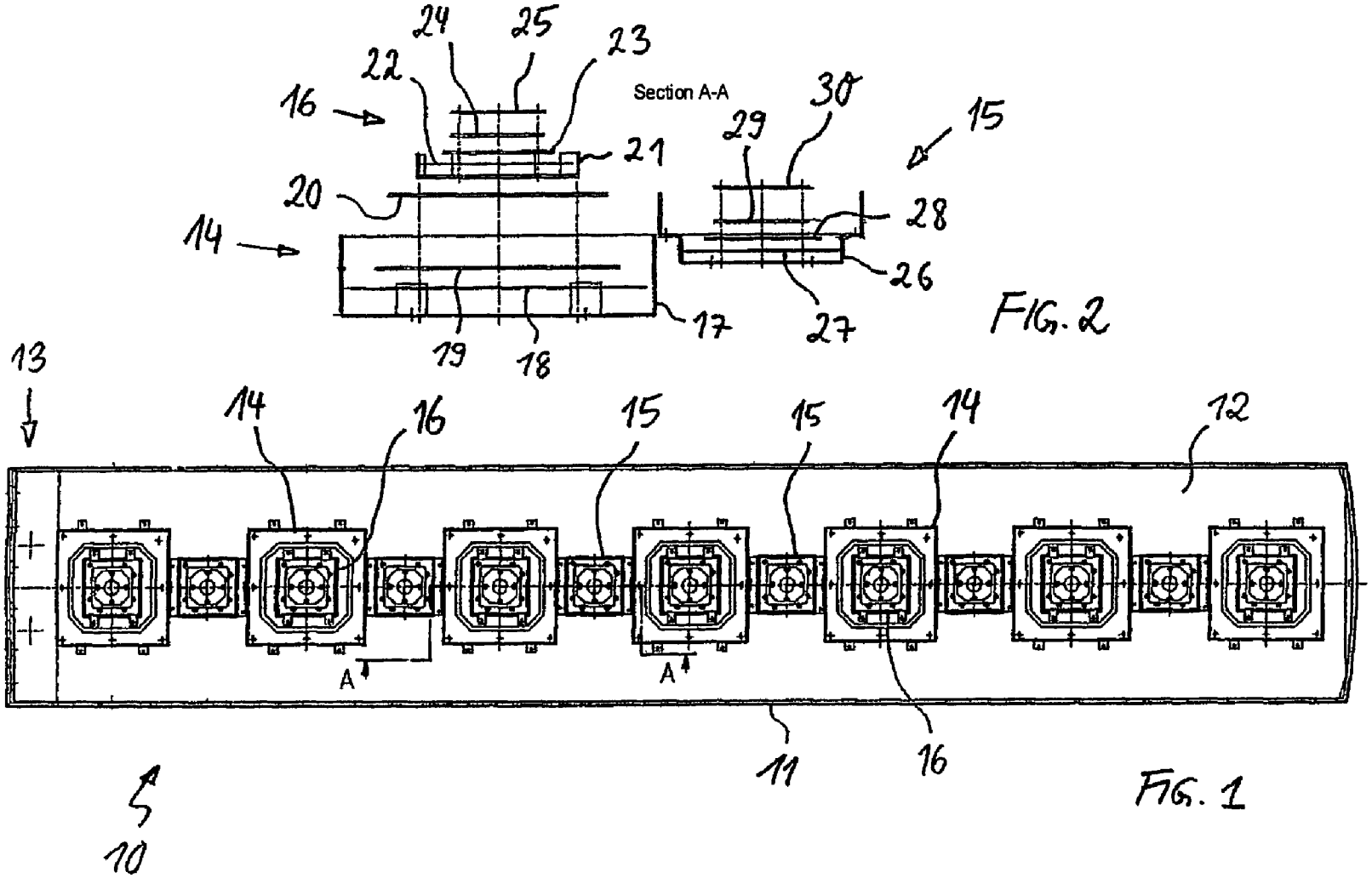
FIG. 1 shows a top view of a dual-band antenna according to a preferred exemplary embodiment of the invention with the cover cap removed.
FIG. 2 shows a section along line A—A in FIG. 1.

FIG. 1 shows a top view of a dual-band antenna according to a preferred exemplary embodiment of the invention with the cover cap removed. The dual-band antenna 10 includes an elongated housing 11, a linear periodic array of first individual antennas (individual radiators) 14 and second individual antennas (individual radiators) 15 and 16 above an elongated baseplate 12 filling the entire housing 11. However, the width of the baseplate can also be reduced to the width of the individual antennas. The baseplate 12 can be non-metallic. However, it can also be metallic and can then act as a reflector. Arranging the individual antennas 14, 15, 16 above a reflector optimizes the front/back ratio.

The first individual antennas 14 and a part of second individual antennas 15 are arranged alternatingly in the linear array. In addition, the remaining second individual antennas 16 are placed about the first individual antennas 14 (see also FIG. 2). In this manner, the distance between the second individual antennas 15, 16 is half as large as the distance between the first individual antennas 14. With a minimum size of the second and first individual radiators, this results in a distance of 0.78-times or 0.87-times the wavelength—in each case related to the center-of-band frequency—between the first and second individual antennas, respectively.

The basic configuration of the first and second individual antennas 14, 15 and 16 can be explained best with reference to the cross-sectional representation of FIG. 2. The configuration of the second individual antennas 15 and 16 is largely identical. In the case of these antennas, a printed-circuit board 22 and 27, respectively, is in each case arranged in spaced parallel relative to the bottom of a square box 21, 26 of sheet metal which is open to the top, the double-sided conductor track or conductor area configuration of which printed-circuit board is reproduced in FIGS. 5 and 6. Above printed circuit boards 22 and 27, three patch plates 23, 24, 25 and 28, 29, 30, respectively, which are excited by printed-circuit boards 22 and 27 and are coupled to the electromagnetic radiation, are arranged at different distance from one another in parallel with printed-circuit boards 22 and 27. The second individual antennas 15, 16 are provided for and tuned to the frequency band of 1710–2170 MHz (GSM 1800, UMTS) (UMTS radiators). Their external dimensions and patch plate distances are, therefore, smaller than in the case of the first individual antennas 14. Second individual antennas 15 and 16 are in each case arranged offset in height above the baseplate 12 (FIG. 2).

Figure 3:
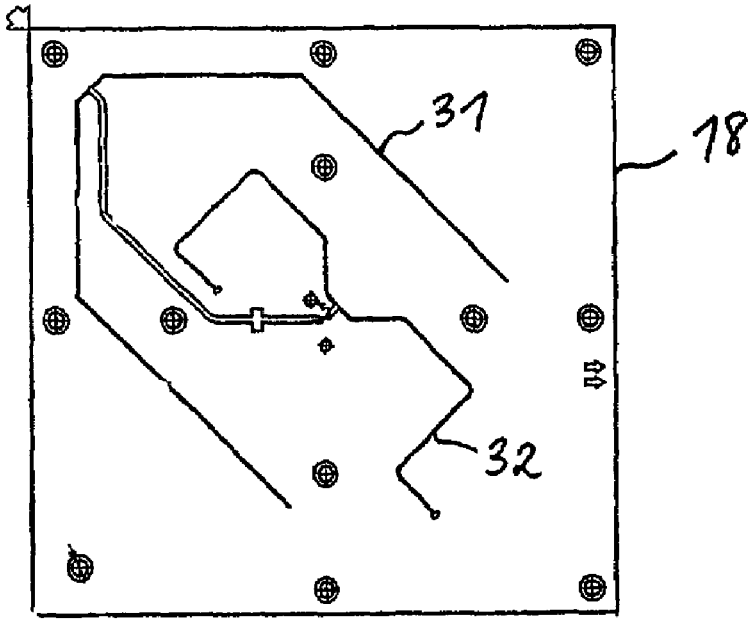
FIG. 3 shows a top view of a printed-circuit board of a first individual antenna FIG. 1.
Figure 4:
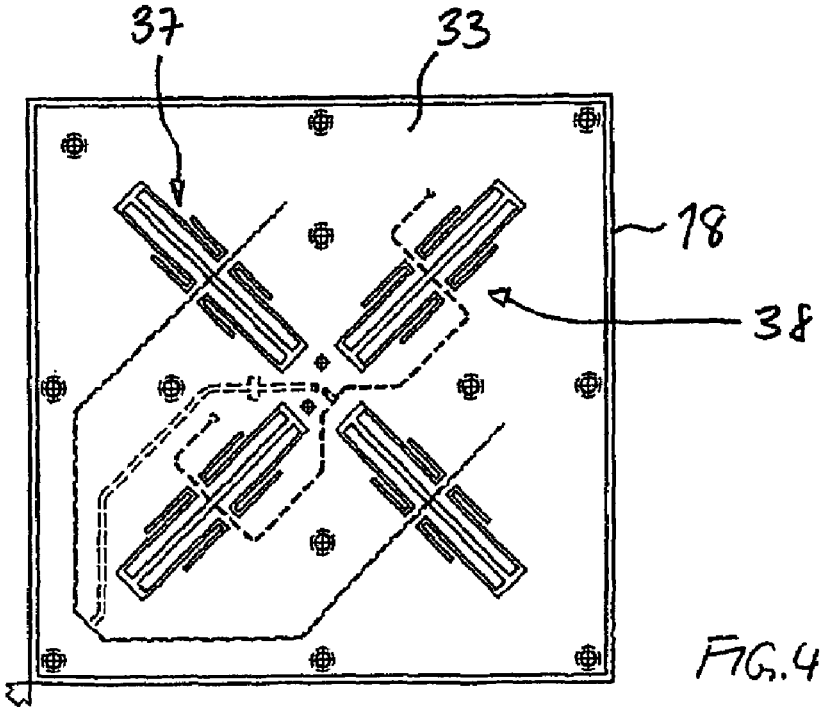
FIG. 4 shows a bottom view of the printed-circuit board of the first individual antenna from FIG. 1.

The first individual antennas 14, which are provided for and tuned to the frequency band of 806–960 MHz (GSM 900 et al) (900 MHz radiators) are configured similarly to the second individual antennas 15, 16. In these, a printed-circuit board 18, the double-sided conductor track or conductor area configuration of which is reproduced in FIGS. 3 and 4, is arranged in spaced parallel relation with the bottom of a larger, square box 17 of sheet metal open to the top. Above the printed-circuit board 18, two patch plates 19 and 20, which are excited by the printed-circuit board 18 and are coupled to the electromagnetic radiation, are provided. Instead of a third patch plate, a second individual antenna 16 with its box 21 is arranged at a distance above the two patch plates 19, 20. Patch plates 19 and 20, and the base of box 21 are arranged at a different distance from one another in parallel with printed-circuit board 18.

Figure 5:
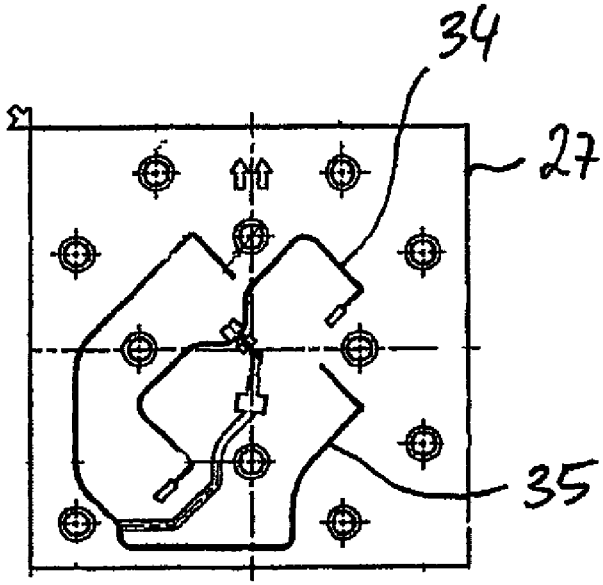
FIG. 5 shows a top view of a printed circuit board of a second individual antenna in FIG. 1.
Figure 6:
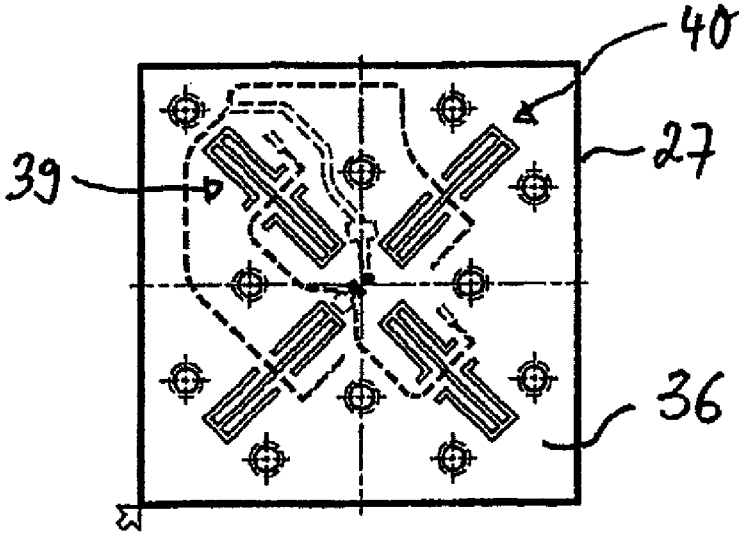
FIG. 6 shows a bottom view of the printed-circuit board of the second individual antenna in FIG. 1.

The printed-circuit boards 18 of the first individual antennas and, the printed-circuit boards 22 and 27 of the second individual antennas 16 and 15, have different conductor tracks 31, 32 and 34, 35, respectively, on their top according to FIGS. 3 and 5, respectively. On the bottoms of printed-circuit boards 18 and printed-circuit boards 22 and 27, ground areas 33 and 36 are provided in which slot-shaped conductor patterns 37, 38 and 39, 40, respectively, are formed in a crossed arrangement. The individual antennas 14, 15, 16 can be fed by any type of network.

The individual antennas 14, 15 and 16 shown in FIG. 1 and 2, differently from the patch radiators of WO-A1-01/76010, do not have any lugs on the four sides of the box 17, 21, 26 which are used for increasing the bandwidth. The necessary bandwidth is achieved by the third (top) patch plate 25, 30. Box 21 of the UMTS radiator (individual antenna 16) on the 900 MHz radiator (individual antenna 14) has an effect comparable to a third patch plate, i.e. the UMTS radiator also increases the bandwidth (due to capacitive coupling between the UMTS box 21 and the two patch plates 19, 20 of the 900 MHz box and the slotted structure (conductor pattern 37, 38) of the printed circuit board 18, additional resonant frequencies are excited which lead to a widening of the bandwidth).

In relation to the function of the base plate 12, it must also be mentioned that it has already been known in the prior art to arrange patch radiators above a metallic base plate. In such known designs, the plate had the function of a reflector and thus predetermined the direction of radiation. In the present arrangement, this task is already fulfilled by box 17, 26 which encloses the individual antenna. The reflector plate is used, on the one hand, as base plate 12 for mounting the boxes 17, 26 and, on the other hand, the front/back ratio is optimized with the spacing of a box above such a reflector plate.

The optimum spacing of the individual antennas 14 and 15, 16, respectively, in the array in the dual-band antenna 10 is 0.7-times the wavelength of the respective band. From this, it follows that the spacing between the UMTS radiators 15, 16 must be approximately half as large as that of the 900-MHz radiators 14. In the present case, the configuration follows this rule. The construction begins and ends with a 900-MHz radiator 14. In this manner, a maximum number of both 900-MHz radiators 14 and of UMTS radiators 15, 16 can be accommodated. As a result, the gain can be maximized and the radiation patterns optimized with a predetermined antenna length. In the example of FIG. 1, a total of seven 900 MHz radiators 14 and 13 UMTS radiators 15, 16 are produced in the array. In the generalized case, a total of N first individual antennas 14 and two N±1 second individual antennas 15, 16 are arranged in the dual-band antenna 10, where N=integral number>0. Thus, variants of the dual-band antenna according to the invention are conceivable in which, for example, five first individual antennas and 9 second individual antennas or 9 first individual antennas and 17 second individual antennas are combined.

Overall, the present invention includes the following special features:

The individual antennas (radiators) are patch radiators and have a printed-circuit board, arranged in a box, with a number of patch plates located above the printed-circuit board.

There are two different types of individual antennas, namely for the 806–960 MHz frequency band (900 MHz radiators) and for the 1710–2170 MHz frequency band (UMTS radiators).

Both types of radiators are arranged in a linear array, the period of the UMTS radiators being half as large as the period of the 900-MHz radiators.

The UMTS radiators are arranged between and above the 900-MHz radiators.

This results in a "stacked-up" arrangement of radiators in which the box of the UMTS radiator is a fixed component of the 900-MHz radiator and contributes to its matching.

The UMTS radiators are arranged offset in height, phase differences occurring being compensated for by different lengths of the feed lines.

The positioning of the patch radiators at a defined distance above a reflector effects an improvement in the front/back ratio.

The invention claimed is:

1. A dual-band antenna comprising a first linear periodic array of first individual antennas for a first frequency band and a second linear periodic array of second individual antennas for a second frequency band, the period of the first linear periodic array being essentially twice as large as the period of the second linear periodic array, the second individual antennas being arranged alternately between the first and above the first individual antennas, and the first individual antennas and second individual antennas being constructed as patch radiators, wherein each first and second individual antennas includes a printed-circuit board arranged in a rectangular, electrically conductive box open to the top and a number of patch plates which are arranged at a distance above one another above the printed-circuit board and in parallel with the printed-circuit board.

2. The dual-band antenna as claimed in claim 1, wherein the patch plates of each individual antenna are held in each case at a distance above one another and from the printed-circuit board by means of electrically insulating spacing elements.

3. The dual-band antenna as claimed in claim 2, wherein each second individual antenna includes three patch plates arranged at a distance above one another, and each first individual antenna includes two patch plates arranged a distance above one another with a box of one of the second individual antenna arranged at a distance above the top one of said two patch plates.

4. The dual-band antenna as claimed in claim 2, wherein the first and second individual antennas are arranged above a common base plate extending in the longitudinal direction of the antenna.

5. The dual-band antenna as claimed in claim 2, wherein the first individual antennas are designed for covering the frequency range of 806–960 MHz and the second individual antennas are designed for covering the frequency range of 1710–2170 MHz.

6. The dual-band antenna as claimed in claim 2, wherein a total of N first individual antennas and 2N±1 second individual antennas are arranged in the dual-band antenna, where N=integral number>0.

7. The dual-band antenna as claimed in claim 1, wherein each second individual antenna includes three patch plates arranged at a distance above one another, and each first individual antenna includes two patch plates arranged a distance above one another with a box of one of the second individual antenna arranged at a distance above the top one of said two patch plates.

8. The dual-band antenna as claimed in claim 7, wherein the first and second individual antennas are arranged above a common base plate extending in the longitudinal direction of the antenna.

9. The dual-band antenna as claimed in claim 7, wherein the first individual antennas are designed for covering the frequency range of 806–960 MHz and the second individual antennas are designed for covering the frequency range of 1710–2170 MHz.

10. The dual-band antenna as claimed in claim 7, wherein a total of N first individual antennas and 2N±1 second individual antennas are arranged in the dual-band antenna, where N=integral number>0.

11. The dual-band antenna as claimed in claim 1, wherein the first and second individual antennas are arranged above a common base plate extending in the longitudinal direction of the antenna.

12. The dual-band antenna as claimed in claim 11, wherein the base plate is constructed as a reflector.

13. The dual-band antenna as claimed in claim 12, wherein the first individual antennas are designed for covering the frequency range of 806–960 MHz and the second individual antennas are designed for covering the frequency range of 1710–2170 MHz.

14. The dual-band antenna as claimed in claim 12, wherein a total of N first individual antennas and 2N±1 second individual antennas are arranged in the dual-band antenna, where N=integral number>0.

15. The dual-band antenna as claimed in claim 11, wherein the first individual antennas are designed for covering the frequency range of 806–960 MHz and the second individual antennas are designed for covering the frequency range of 1710–2170 MHz.

16. The dual-band antenna as claimed in claim 11, wherein a total of N first individual antennas and 2N±1 second individual antennas are arranged in the dual-band antenna, where N=integral number>0.

17. The dual-band antenna as claimed in claim 1, wherein the first individual antennas are designed for covering the frequency range of 806–960 MHz and the second individual antennas are designed for covering the frequency range of 1710–2170 MHz.

18. The dual-band antenna as claimed in claim 17, wherein a total of N first individual antennas and 2N±1 second individual antennas are arranged in the dual-band antenna, where N=integral number>0.

19. The dual-band antenna as claimed in claim 1, wherein a total of N first individual antennas and 2N±1 second individual antennas are arranged in the dual-band antenna, where N=integral number>0.

20. The dual-band antenna as claimed in claim 19, wherein N=7.

* * * * *